US006688832B1

(12) United States Patent
Zysset

(10) Patent No.: US 6,688,832 B1
(45) Date of Patent: Feb. 10, 2004

(54) EASY-OPEN END AND METHOD OF MAKING

(75) Inventor: Edgar Zysset, St. Cloud, FL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/547,616

(22) Filed: Apr. 12, 2000

(51) Int. Cl.[7] ..... B21D 51/44

(52) U.S. Cl. ..... 413/17; 413/8; 413/12; 413/13; 413/14; 413/15

(58) Field of Search ..... 413/8, 12–17, 413/67, 68; 220/269, 270, 272, 273, 276

(56) References Cited

U.S. PATENT DOCUMENTS 3,853,080 A * 12/1974 Zundel ..... 413/13
3,871,314 A * 3/1975 Stargell ..... 413/13
3,945,334 A * 3/1976 Ostrem et al. ..... 413/12
3,990,376 A * 11/1976 Schubert et al. ..... 413/17
4,052,949 A * 10/1977 Woodley ..... 413/13
4,055,134 A * 10/1977 Ostrem et al. ..... 413/13
4,511,299 A 4/1985 Zysset
5,038,956 A * 8/1991 Saunders ..... 413/14

* cited by examiner

*Primary Examiner*—John Sipos
*Assistant Examiner*—Louis Huynh
(74) *Attorney, Agent, or Firm*—Knoble & Yoshida, LLC

(57) ABSTRACT

A method of making an easy-open end for a container includes steps of forming first and second grooves in a panel of a can end blank, the grooves extending below the level of the panel to form inner and outer beads and forming a central bead in the panel between the first and second grooves so that the central bead extends above the panel. A score is then formed along the central bead by simultaneously forming the score and compressing the central bead, so that the depth of the score and the thickness of the central bead are both positively controlled. The inner and outer beads are then forced toward each other and then toward the panel, and the central bead is forced toward the panel. A pull-tab is then fixed to the end. This process permits the score residual to be controlled to a greater tolerance than the conventional processes, and is also more material efficient.

9 Claims, 4 Drawing Sheets

EASY-OPEN END AND METHOD OF MAKING

BACKGROUND OF THE INVENTION

1. Field of the Invention

This invention relates generally to containers, and particularly to containers of the type having an easy-open end that is openable by a pull-tab mechanism.

2. Description of the Related Technology

The term "easy open end" is used generally for that class of ends for containers which are provided with a mechanism for permitting the consumer to open the container at the end for access to the ingredients within the container, without the use of a can opener or other machinery. One conventional easy open end technique employs a pull tab having a pointed nose, the pull tab being riveted to the panel of the end so that the nose rests adjacent a weakened area along the periphery of the end panel. To open, the pull tab is rotated about the rivet, causing the nose to fracture the weakened area. Further pulling of the tab away from the end panel then causes the remainder of the weakened peripheral to rupture, thereby permitting the entire end to be opened.

One form of easy-open end that is in wide use is the so called "full-open" end, in which a peripheral score, generally circular in configuration, is formed in the end panel at or adjacent to the periphery thereof to permit its complete removal. Full-open type cans are to be distinguished from those self opening cans which have a comparatively small removable section which, when opened, provide a comparatively small hole for dispensing the product. The latter type of can end is only appropriate for packaging soda, beer, or other liquids. Full-open type cans, on the other hand, are suitable for packaging solid products such as candy, nuts, meats, or ground coffee.

One disadvantage of easy-open ends that is generally recognized by everyone who is involved in the field relates to the sharp edges that result after the can end is opened and the consequential safety issues. U.S. Pat. No. 4,511,299 to Zysset addresses these issues, and is notable in that it provided the concept of using blunt, protective shoulders formed by folding the panel end wall near the line of weakness. The method that is disclosed in the Zysset patent is depicted in FIGS. 1 through 6. As may be seen in FIG. 1, the starting material is a planar can end blank 10. The end blank 10 is first subjected to a first bending step to form bend 16 and a portion of a side curl 18 at the peripheral edge of the end 10. As shown in FIG. 2, the end is then subjected to another bending and forming step to create a pair of concentric grooves 20, 22 which define inner and outer beads 21, 23 that extend below the second, inner surface 14 of the end 10. Also formed is a central bead 24, which extends above the level of the first, outer surface 12 of the end 10. As is shown in FIG. 2, the groove 20 (and as a consequence the bead 21) extends a greater distance below the level of the second surface 14 than the outer bead 23. This dimensional characteristic is provided to insure sufficient metal on the inside of the tear area as opposed to the outside area.

Referring now to FIG. 3, the end 10 is subjected to another forming step wherein the portion of the end 10 inside the bead 21 is rolled upward, and the second bead 23 is extended downwardly. Thereafter, as is shown in FIG. 4, a score 28 is formed on the central bead 24, and then the inner and outer beads 21, 23 are forced toward the inside surface 14 and the central bead 24 is forced toward the outside surface 12 until the inner and outer beads 21, 23 abut the central bead 24 to provide blunt, protective shoulders underneath the score line 28 (see FIG. 5). The protective shoulders formed by the inner and outer beads 21, 23 lie in a common plane which is substantially parallel to, but spaced from the plane of the end 10. As is shown in FIG. 6, the completed end is provided with a pull-tab 34, the extremity of which extends adjacent to the score line 28 to permit the end to be opened in a conventional manner. As may be seen in FIGS. 6 and 7, a completed end fabricated in accordance with the method shown in FIGS. 1–5 includes the central bead 24 that contains the score line which is flush with the end 10 and resides essentially in the plane of the end 10, and concentric recesses 30, 32 that surround the central bead. The recesses 30, 32 are formed by the specific bending technique described below with respect to the inner and outer beads 21, 23.

In all types of easy open ends, including that which is described above, it is important to tightly control the manufacturing tolerances of what is termed the residual, which is the thickness of material remaining after the score has been made in the end panel. The residual is of course affected by the original thickness of the end panel in the area at which the score is been made, as well as the specific tooling and procedure by which the scoring process is accomplished. In the process that is described above and in the Zysset patent, the bending of the end panel of the end blank of course changes the thickness of the end panel in different locations, including the central bead area 24 in which the score 28 is to be placed. In general, the creation of the shoulders on each side of the location at which the score 28 is to be placed will tend to thicken this central a bead 24, which, when the scoring is performed with standard tooling, will have the effect of increasing the residual to an unwanted and unpredictable extent.

In addition, the step of compressing the beads 21, 23, 24 that occurs between FIGS. 4 and 5 will have the effect of causing material to migrate out of the shoulder areas into adjacent areas, where it is unwanted. The resulting excess material represents an added cost to the container manufacturer which is generally to be avoided.

A need exists for an improved easy-open end and a process for making such an end that is capable of controlling the score residual to a greater tolerance, and that is also further more material efficient than the process that is described above.

SUMMARY OF THE INVENTION

It is an object of the invention to provide an improved easy-open end a process for making such an end that is capable of controlling the score residual to a greater tolerance than the process that is described above, and that is also further more material efficient than the process that is described above.

In order to achieve the above and other aspects of the invention, a method of making an easy-open end for a container includes steps of providing a can end having a peripheral edge and a panel that has opposing first and second sides with the first side adapted to face toward the inside of a container when the end is affixed thereto; forming first and second grooves in the panel spaced from the peripheral edge, the grooves extending below the level of the first side to form inner and outer beads; forming a central bead in the panel between the first and second grooves, the central bead extending above the level of the second surface; forming a score along the central bead by simultaneously forming the score and compressing the central bead, whereby the depth of the score and the thickness of the central bead are both positively controlled; forcing the inner and outer beads toward each other and then toward the first surface and the central bead toward the second surface until the inner and outer beads abut the central bead; and fixing a pull-tab to the end, the pull-tab having means for severing the end along the score.

According to a second aspect of the invention, a method for forming a container having a pull-tab removable end includes steps of providing a metallic can end; forming inner and outer concentric beads in the end extending away from the end, the inner bead extending a greater distance away from the end than the outer bead; forming a score between the inner and outer beads by simultaneously forming the score and compressing the central bead, whereby the depth of the score and the thickness of the central bead are both positively controlled; forcing the inner and outer beads toward each other and toward the plane of the end until the beads abut the end; and fixing a pull-tab to the end, the pull-tab having means for severing the end along the score.

These and various other advantages and features of novelty that characterize the invention are pointed out with particularity in the claims annexed hereto and forming a part hereof.

However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
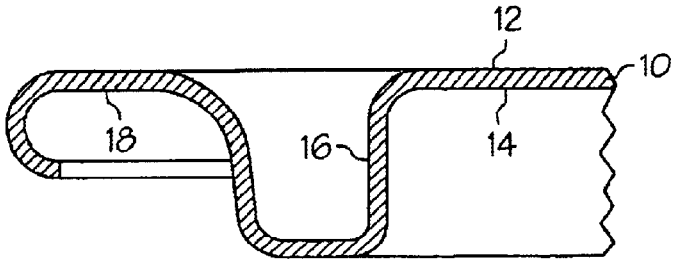
FIG. 1 (PRIOR ART)
FIGS. 1–6 are cross-sections illustrating steps in a prior art method of forming an easy-open end.
Figure 2:
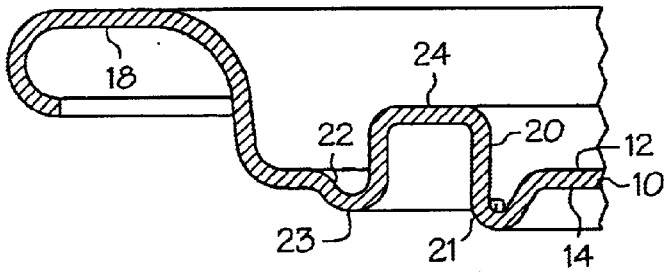
FIG. 2 (PRIOR ART)
Figure 3:
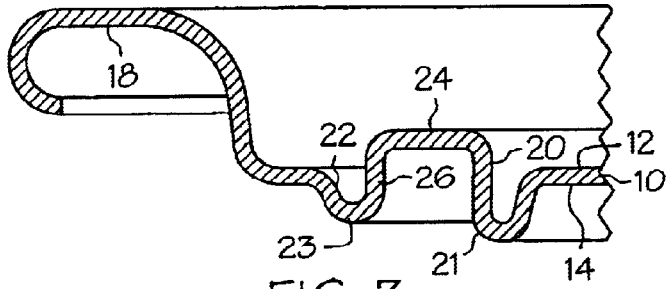
FIG. 3 (PRIOR ART)
Figure 4:
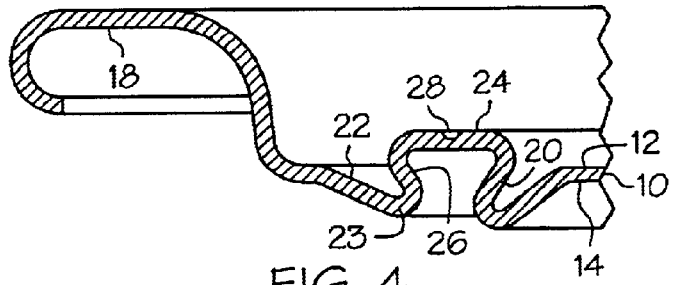
FIG. 4 (PRIOR ART)
Figure 8A:
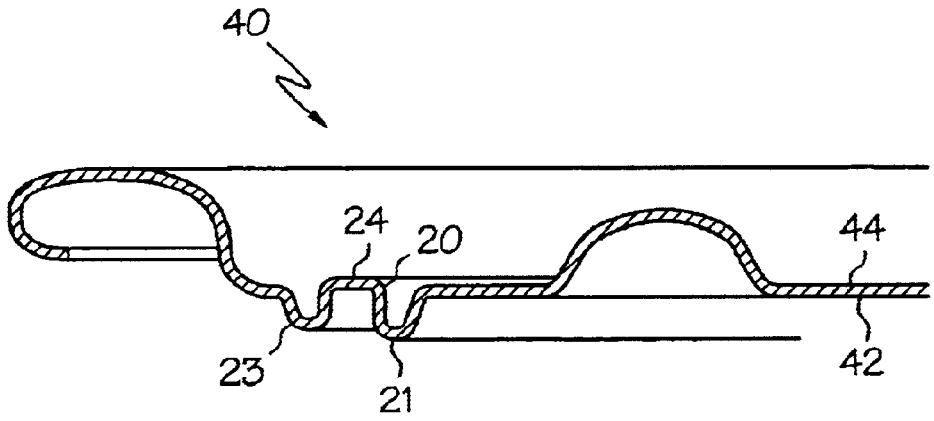
FIGS. 8(*a*) and 8(*b*) are diagrammatical views depicting a process for making an easy-open can end according to a preferred embodiment of the invention.
Figure 8B:
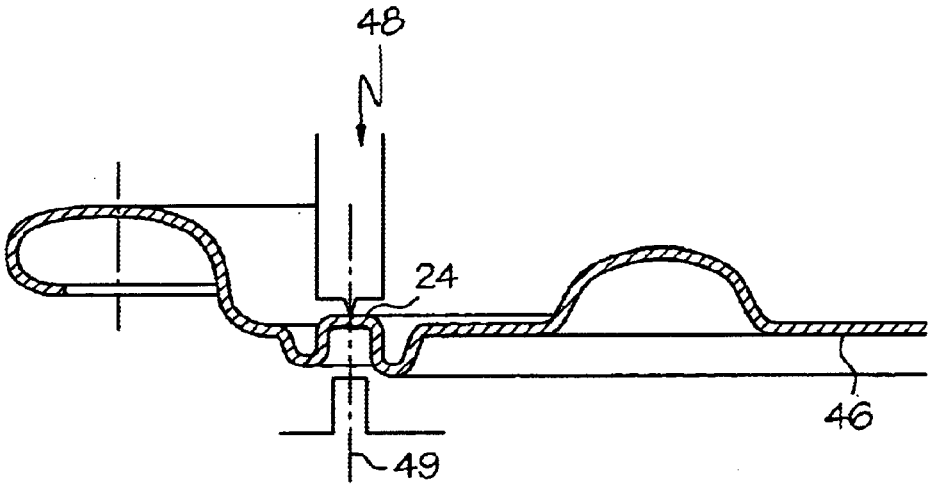

Referring now to the drawings, wherein like reference numerals designate corresponding structure throughout the views, and referring in particular to FIG. 8(*a*), a can end 40 having a panel 42, a top surface 44 and a bottom surface 46 is substantially identical to the can end that is depicted in FIG. 3. Accordingly, can end 40 includes a pair of concentric grooves 20, 22 which define inner and outer beads 21, 23 that extend below the second, inner surface 46 of the can end 40. Can end 40 further includes a central bead 24 that extends above the level of the first, outer surface 44 of the can end 40.

Figure 9:
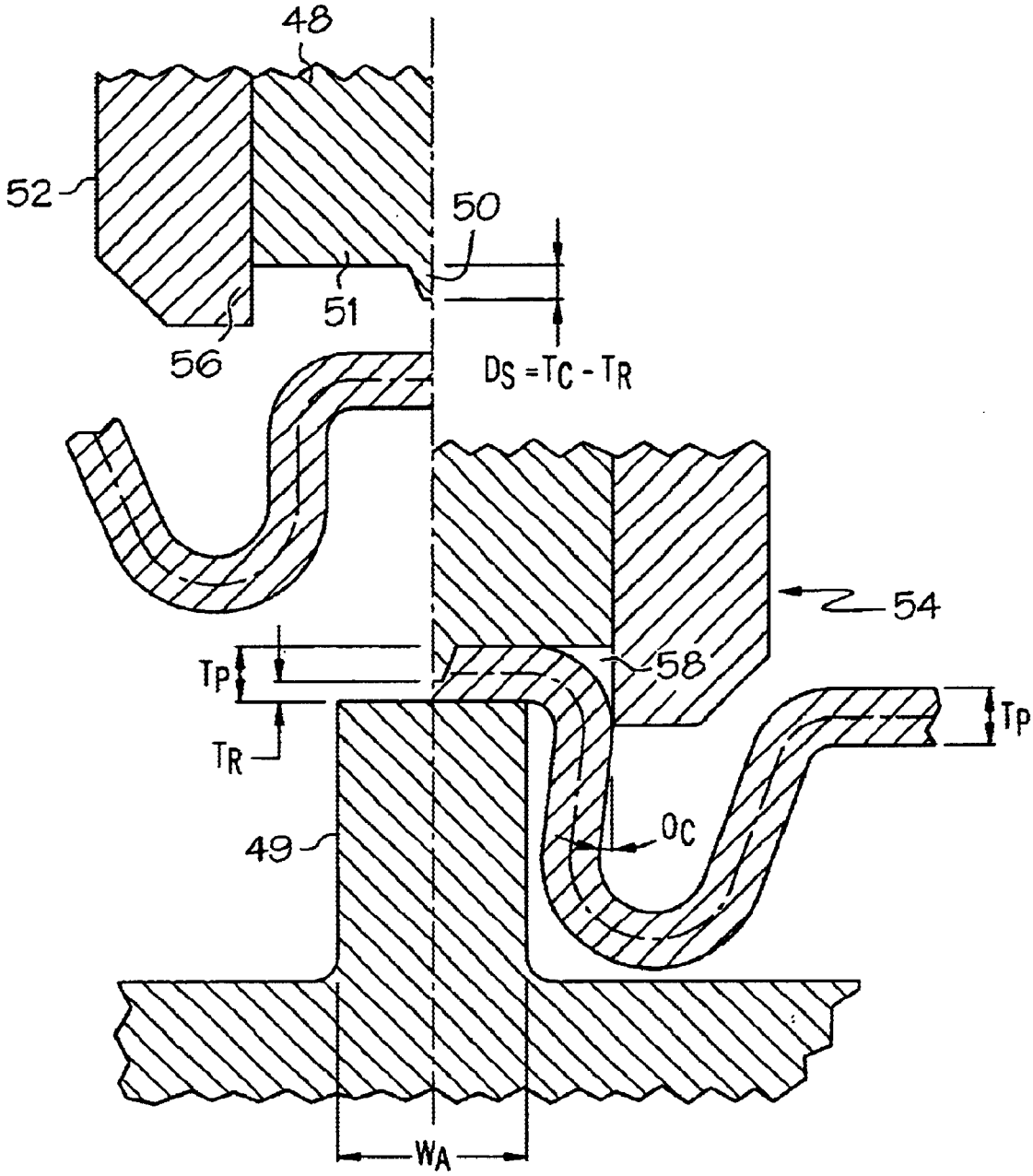
FIG. 9 is a diagrammatical view further depicting the process that is shown in FIGS. 8(*a*) and 8(*b*).

Referring now to FIG. 8(*b*), a fabricating mechanism according to a preferred embodiment of the invention is depicted that includes a scoring punch 48 which is coupled with an anvil 49 to simultaneously score the outer surface of the central bead 24 and compress the central bead 24, so as to positively control both the depth of the resulting score and the final thickness of the central bead 24. As will be appreciated from viewing FIGS. 8 and 9, both scoring punch 48 and anvil 49 are annular in shape the so as to be properly configured to perform the scoring operation on the outer surface of central bead 24 about its entire circumference. This fabricating mechanism is also illustrated diagrammatically in FIG. 9. As may be seen in FIG. 9, scoring punch 48 includes a scoring projection 50 that is shaped to the desired profile of the score that is to be formed on of the outer surface of central bead 24 and that has a length from its base to its tip that is dimensionally represented in FIG. 9 by the value $D_S$. The desired final thickness of the central bead 24 is indicated in FIG. 9 has a value $T_P$. The desired final residual value is indicated as $T_R$. The thickness of the score itself is represented as $T_C$. As is further depicted in FIG. 9, the anvil 49 is shaped and sized to fit between the first and second grooves 21, 23 on the inner or bottom surface 46 of the can end 40. The width of anvil 49 is dimensionally indicated in FIG. 9 as $W_A$.

In one embodiment that has been constructed and has been found to possess superior characteristics, $T_P$ has a value of about 0.0095 nominal inches, and $T_R$ is formed to be within a range of about 0.0035 inches to about 0.0045 inches. The angle $\alpha$ is within a range of about 1 degree to about 7 degrees.

Figure 5:
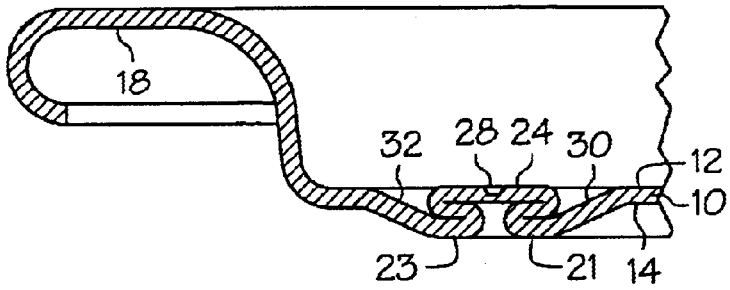
FIG. 5 (PRIOR ART)
Figure 6:
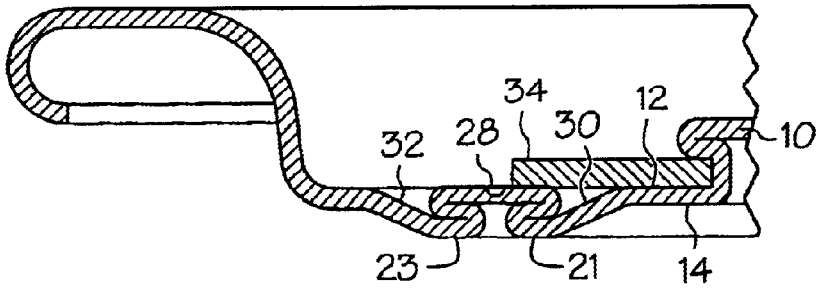
FIG. 6 (PRIOR ART)
Figure 7:
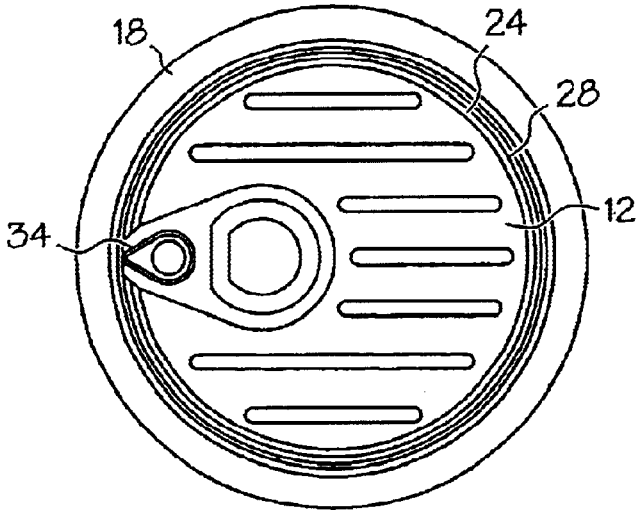
FIG. 7 (PRIOR ART)
FIG. 7 is a top plan view of a end construction in accordance with the prior art.

Another important aspect of the invention is the provision of first and second annular limiting rings 52, 54 that are positioned radially inwardly and outwardly from the scoring projection 50 and that are mounted for movement along with the scoring punch 48. The limiting rings 52, 54 respectively include limiting surfaces 56, 58 that are constructed and arranged to engage the outer surface 44 of the panel 42 on sides of the inwardly extending concentric beads 21, 23 that are immediately adjacent to the central bead 24. As may be seen in FIG. 9, this causes the portions of the panel wall 42 that define the sides of the grooves that are adjacent to the central bead to be deflected as to form an acute angle with respect to a plane in which the central bead resides. This acute angle may be defined as 90 degrees minus the angle a that is depicted in FIG. 9. This feature of the invention limits the amount of material creep that occurs during the simultaneous scoring and pressing step, and also facilitates the step that is depicted in FIG. 5, in which the beads 21, 23 are flattened to form the protective shoulders when each side of the score line.

A method of making an easy open can for a container according to the preferred embodiment of the invention includes a first step of providing a can end that has a peripheral edge and a panel, the panel having opposing first and second sides with the first side adapted to face toward the inside of a container when the end is affixed to the container. Next, in a process that is similar or identical to that which has been described above in reference to the prior art Zysset patent, first and second grooves are formed in the panel in positions that are spaced from the peripheral edge. These grooves will extend below the level of the first side 46 of the panel 42 to form inner and outer beads 21, 23. At this point, the central bead 24 is formed in the panel 42 between the first and second grooves or beads 21, 23. The central bead 24 will extend above the level of the second, outer surface 44 of the panel 42, as may be seen in FIGS. 8(*a*) and 8(*b*). After the central bead has been formed, a score will be formed along the central bead 24 by simultaneously forming the score by interaction of the scoring projection 50 of scoring punch 48 and the anvil 49 and compressing the central bead 24 by interaction of the pressing surface 51 of scoring punch 48 with the anvil 49. As this occurs, material flow or creep is positively restricted by the presence of the limiting rings 52, 54. In addition to limiting material creep, the limiting rings 52, 54 perform the additional advantageous function of engaging the walls of the beads or grooves that are adjacent to the central bead 24 and deflecting those walls inwardly as is described above and is depicted in FIG. 9.

Aided by the deflection that is created by the limiting rings 52, 54, the inner and outer beads are then forced toward each other and then toward the first, top surface 44 of panel 42 until the inner and outer beads 21, 23 abut the central bead 24. A pull tab is then affixed to the can end 40 in conventional fashion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of making an easy-open end for a container, comprising steps of:

(a) providing a can end having a peripheral edge and a panel, said panel having opposing first and second sides with said first side adapted to face toward the inside of a container when said end is affixed thereto;

(b) forming first and second grooves in said panel spaced from said peripheral edge, said grooves extending below the level of said first side to form inner and outer beads;

(c) forming a central bead in said panel between said first and second grooves, said central bead extending above the level of said second side with inner and outer shoulders that are unitary with said inner and outer beads, respectively;

(d) forming a score along said central bead by using an annular scoring punch and an annular anvil that is shaped and sized to fit between said inner and outer beads, said annular scoring punch including an annular scoring projection and at least one pressing surface, said annular scoring punch and annular anvil interacting by simultaneously forming the score and compressing the central bead, whereby the depth of the score and the thickness of the central bead are both positively controlled and so that a predetermined amount of material migrates from said central bead into said inner and outer shoulders;

(e) forcing said inner and outer beads toward each other and then toward said first side and said central bead toward said second side until said inner and outer beads abut said central bead; and (f) fixing a pull-tab to said end, said pull-tab having means for severing said end along said score.

2. A method according to claim 1, wherein step (b) is performed by forming first and second concentric grooves in said panel spaced from said peripheral edge.

3. A method according to claim 1, wherein said annular scoring punch comprises a scoring projection and at least one pressing surface that is adjacent to said scoring projection for, in conjunction with said anvil, compressing the central bead.

4. A method according to claim 3, wherein step (d) further comprises a step of positively restricting material flow while simultaneously forming the score and compressing the central bead.

5. A method according to claim 4, wherein the restriction of material flow is performed with a limit ring acting in association with said annular scoring punch for restricting material flow.

6. A method according to claim 1, wherein step (d) further comprises a step of positively restricting material flow while simultaneously forming the score and compressing the central bead.

7. A method according to claim 6, wherein the restriction of material flow is performed with a limit ring acting in association with said annular scoring punch for restricting material flow.

8. A method according to claim 1, wherein step (d) further is performed so that the panel wall that defines a side of at least one of said grooves that is adjacent to said central bead is deflected as to form an acute angle with respect to a plane in which said central bead resides, thereby facilitating step (e).

9. A method according to claims 8, wherein said deflection is performed with a limit ring acting in association with said annular scoring punch for restricting material flow.

* * * * *